US009010952B2

(12) United States Patent
Lenahan et al.

(10) Patent No.: US 9,010,952 B2
(45) Date of Patent: Apr. 21, 2015

(54) LIQUOR BOTTLE AND CAP THEREFOR

(75) Inventors: Chris Lenahan, Las Vegas, NV (US); Danny Mills, Beaverton, OR (US); Lyle Andrew Ramsdell, Lake Oswego, OR (US)

(73) Assignee: Edge Beverage 2 LLC, Portland, OR (US)

( * ) Notice: Subject to any disclaimer, the term of this patent is extended or adjusted under 35 U.S.C. 154(b) by 445 days.

(21) Appl. No.: 13/397,308

(22) Filed: Feb. 15, 2012

(65) Prior Publication Data

US 2012/0261379 A1 Oct. 18, 2012

Related U.S. Application Data

(60) Provisional application No. 61/443,555, filed on Feb. 16, 2011.

(51) Int. Cl.

| | |
|---|---|
| ***F21V 33/00*** | (2006.01) |
| ***B67D 3/00*** | (2006.01) |
| ***B65D 47/08*** | (2006.01) |
| ***B65D 23/10*** | (2006.01) |
| ***B65D 47/06*** | (2006.01) |
| ***B65D 51/16*** | (2006.01) |
| ***B65D 51/24*** | (2006.01) |

(52) U.S. Cl.

CPC ..... *B65D 23/102* (2013.01); *B65D 47/065* (2013.01); *B65D 51/1672* (2013.01); *B65D 51/248* (2013.01)

(58) Field of Classification Search

CPC ..... F21Y 2103/022; F21V 33/0004; F21W 2121/00; F21W 2121/02; F21S 10/002; A47G 2019/2238; A47G 19/2227; A47G 19/2255; B65D 51/248; B65D 23/102; B65D 47/065; B65D 51/1672

USPC ..... 362/96, 101, 216; 222/113, 478, 479, 222/481, 481.5, 482–484, 533, 534, 536, 222/537, 540, 544, 556, 566–568; 215/307, 215/311, 313, 387–389

See application file for complete search history.

(56) References Cited

U.S. PATENT DOCUMENTS

| | | | | |
|---|---|---|---|---|
| 4,015,756 | A | 4/1977 | Beck | |
| 4,519,529 | A * | 5/1985 | Seltz | 222/484 |

(Continued)

FOREIGN PATENT DOCUMENTS

| | | |
|---|---|---|
| WO | WO 2004/110892 | 12/2004 |

OTHER PUBLICATIONS

TY KU Citrus Liqueur—The World's Only Illuminating Bottle, downloaded from http://www.trytyku.com/liqueur.html, 2 pp. (document not dated, downloaded on Oct. 16, 2012).

*Primary Examiner* — Alan Cariaso
(74) *Attorney, Agent, or Firm* — Klaquist Sparkman, LLP

(57) ABSTRACT

A cap for a liquor bottle can have an upper wall, a cylindrical outer wall and an internally threaded inner wall configured to be secured to an externally threaded neck of a liquor bottle. The cap can include a spout pivotally coupled to the upper wall comprising first and second parallel internal passageways extending longitudinally through the spout and configured to pivot between an open position and a closed position. An annular light ring can be positioned between the outer and inner walls and can include light sources configured to emit light downwardly toward an annular shoulder of the liquor bottle. The light sources can emit light in various different manners.

20 Claims, 11 Drawing Sheets

(56) References Cited

U.S. PATENT DOCUMENTS

| | | | | |
|---|---|---|---|---|
| 4,732,303 | A * | 3/1988 | Wang | 222/484 |
| 4,776,501 | A * | 10/1988 | Ostrowsky | 222/517 |
| 5,709,318 | A * | 1/1998 | Oder | 222/153.06 |
| 5,797,521 | A | 8/1998 | Sobral | |
| 5,873,478 | A * | 2/1999 | Sullivan et al. | 215/389 |
| 6,520,378 | B1 | 2/2003 | Goettner et al. | |
| 6,857,755 | B1 | 2/2005 | Lewis | |
| 6,886,958 | B1 * | 5/2005 | Grant | 362/101 |
| 7,040,776 | B2 * | 5/2006 | Harrell et al. | 362/154 |
| D577,590 | S | 9/2008 | Ulicny | |
| 7,699,490 | B2 * | 4/2010 | Tsai et al. | 362/154 |
| 7,740,368 | B2 | 6/2010 | Chiang | |
| 8,011,816 | B1 | 9/2011 | Janda | |
| 2004/0004829 | A1 | 1/2004 | Policappelli | |
| 2004/0264171 | A1 | 12/2004 | King et al. | |
| 2006/0250784 | A1 | 11/2006 | Langone | |
| 2007/0014100 | A1 | 1/2007 | Perez et al. | |
| 2007/0201220 | A1 | 8/2007 | Ulicny | |
| 2008/0035515 | A1 | 2/2008 | Dikopf | |

* cited by examiner

LIQUOR BOTTLE AND CAP THEREFOR

CROSS REFERENCE TO RELATED APPLICATION

This application claims the benefit of U.S. Provisional Patent Application No. 61/443,555, filed Feb. 16, 2011, which is incorporated by reference herein in its entirety.

FIELD

The application relates to liquor bottles and caps therefor.

BACKGROUND

In a dark bar or nightclub, it can be difficult to recognize conventional liquor bottles and differentiate one from another. Most liquor bottles all have the same general shape and rely on labels and external lighting for recognition. Some bars include special lighting to help illuminate their array of liquor bottles.

In addition, conventional liquor bottles come with a sealed screw cap that the bartender removes and replaces with a conventional pour spout. Typically, when one bottle of a certain liquor is empty, the bartender will pull the pour spout out of the empty bottle and reinsert it into a full bottle. When a partially empty liquor bottle is not in use, it typically sits on a shelf with a pour spout exposed for long periods of time, often for days and weeks. Over time, the pour spouts become crusty and dirty, and fruit flies often climb into the exposed opening of the pour spout.

SUMMARY

A cap for a liquor bottle can have a generally circular, flat upper wall, a cylindrical outer wall and an internally threaded inner wall extending downward from the upper wall within the outer wall and configured to be secured to an externally threaded neck of a liquor bottle. The cap can include a spout pivotally coupled to the upper wall comprising first and second parallel internal passageways extending longitudinally through the spout and configured to pivot between an open position wherein the passageways are in liquid communication with openings in the upper wall and a closed position wherein the openings are blocked. An annular light ring can be positioned between the outer and inner walls under the upper wall and can include light sources configured to emit light downwardly toward an annular shoulder of the liquor bottle. The light sources can emit light in various different manners, such as in different colors and flashing patterns.

The foregoing and other objects, features, and advantages of the invention will become more apparent from the following detailed description, which proceeds with reference to the accompanying figures.

DETAILED DESCRIPTION

Described herein are embodiments of liquor bottles, caps therefor, and components thereof. The following description is exemplary in nature and is not intended to limit the scope, applicability, or configuration of the invention in any way. Various changes to the described methods may be made in the function and arrangement of the elements described herein without departing from the scope of the invention.

As used in this application and in the claims, the singular forms "a," "an," and "the" include the plural forms unless the context clearly dictates otherwise. The teams "a plurality of" and "plural" mean two or more of the specified element. The term "includes" means "comprises." As used herein, the term "and/or" used between the last two of a list of elements means any one or more of the listed elements. For example, the phrase "A, B, and/or C" means "A," "B," "C," "A and B," "A and C," "B and C" or "A, B and C." Further, the term "coupled" generally means physically coupled or linked and does not exclude the presence of intermediate elements between the coupled or associated items absent specific contrary language.

The dimensions and descriptions shown in the accompanying figures are exemplary of the particular embodiments shown and do not limit the scope of the invention in any way. The sizes and shapes of the embodiments shown can be varied as desired to accommodate alternative applications without departing from the scope of the invention.

Figure 1:
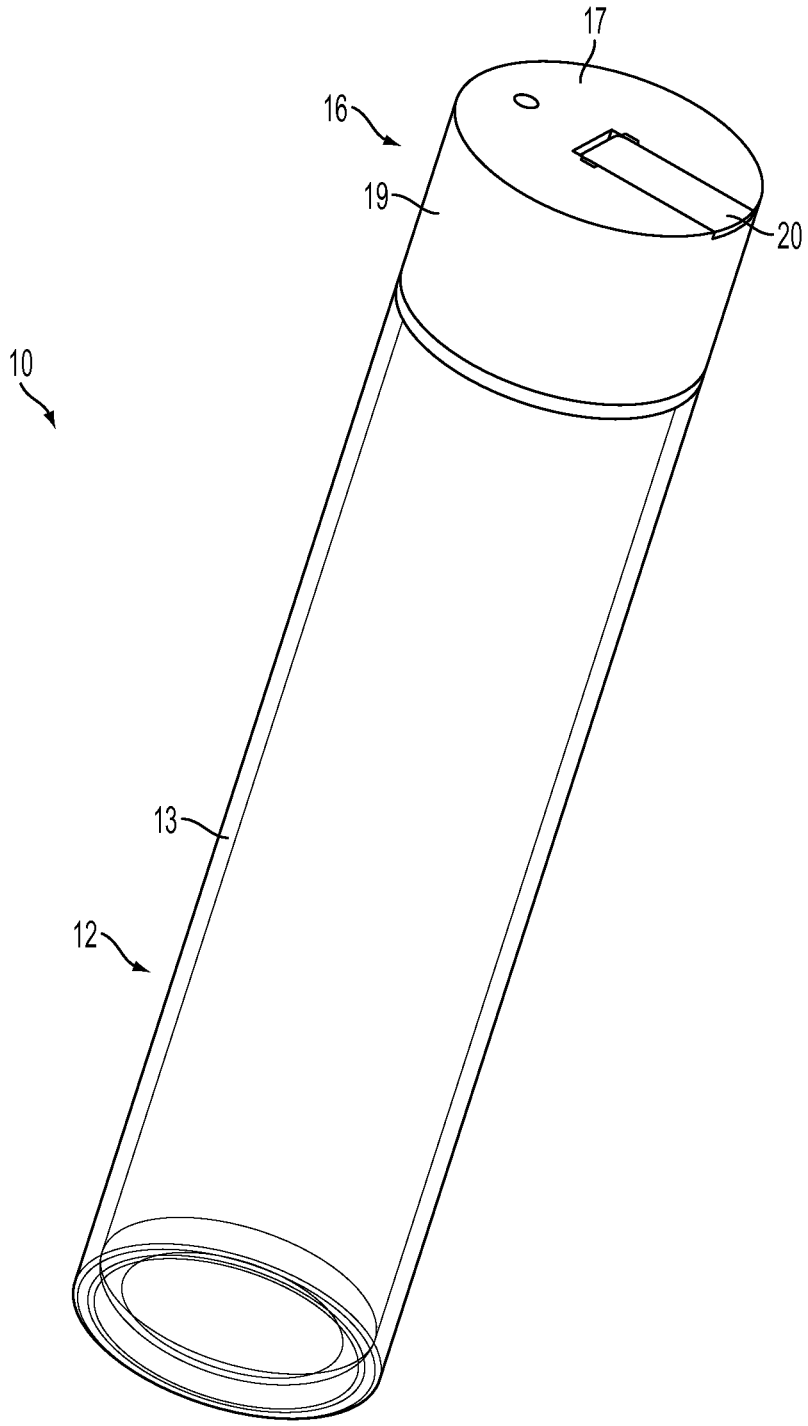
FIG. 1 is an isometric view of an exemplary embodiment of a container comprising a bottle and a cap with a pivotable spout.
Figure 2:
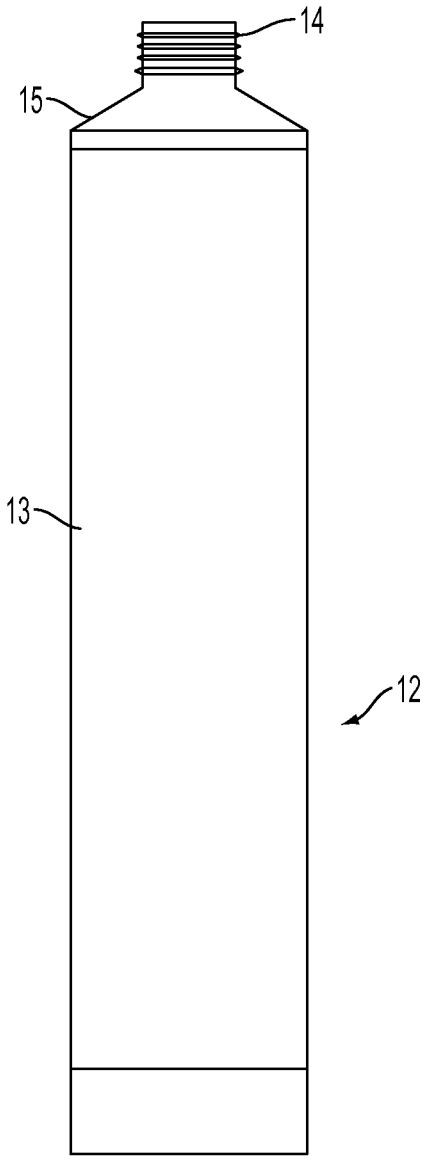
FIG. 2 is an elevation view of an exemplary one-liter liquor bottle.
Figure 3:
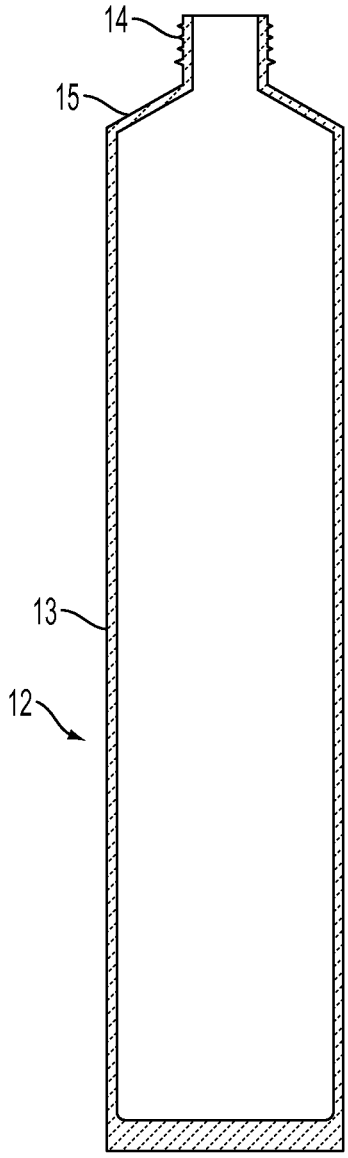
FIG. 3 is a cross-sectional elevation view of the bottle of FIG. 2.
Figure 4:
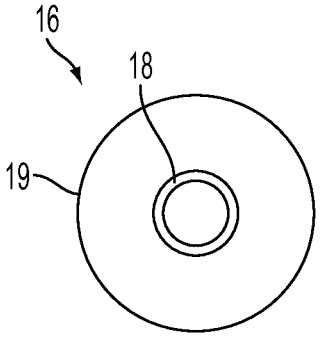
FIG. 4 is a top view of the bottle of FIG. 2.
Figure 5:
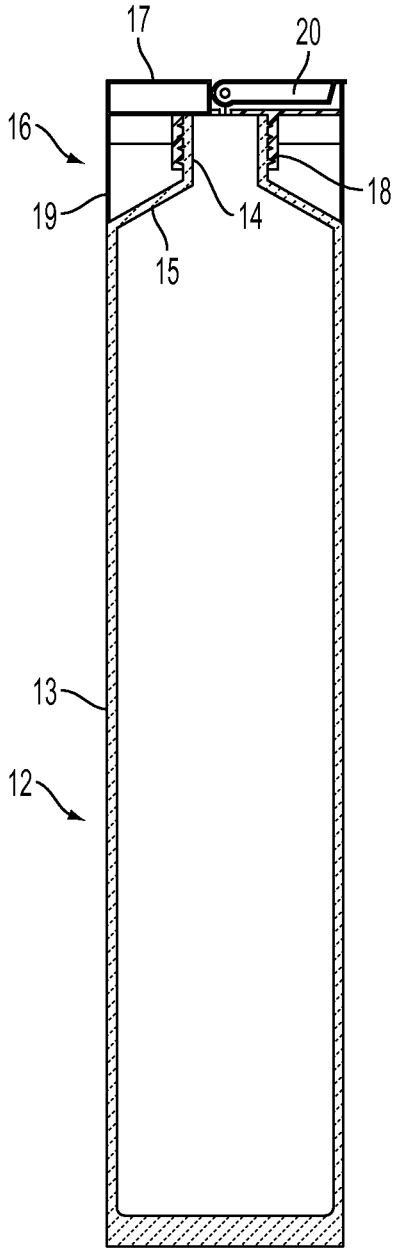
FIG. 5 is a cross-sectional elevation view of the container of FIG. 1.

As shown in FIG. 1, a container 10 can comprise a bottle 12 and a cap 16. As shown in FIGS. 2-5, the bottle 12 can comprise a generally cylindrical body 13, a tapered shoulder 15, and an externally threaded neck 14 forming an upper opening. The bottle can be comprised of glass, plastic, or other conventional materials. In some embodiments, the bottle is comprised of frosted glass or other semi-transparent material. The bottle 12 can be a conventional one-liter or 750 ml liquor bottle, for example.

As shown in FIGS. 5-13, the cap 16 can comprise a circular, generally flat upper wall 17, an inner cylindrical wall 18 and an outer cylindrical wall 19. The inner wall 18 can be internally threaded and can mate with the externally threaded neck 14 of the bottle 12 to secure the cap to the bottle. A gasket (not shown) can be positioned around the neck 14 to seal the inner wall 18 of the cap with the neck to prevent liquid from leaking out between the threads. The outer wall 19 of the cap 16 can have an outer diameter equal to, or similar to, the outer diameter of the body of the bottle 12. As shown in FIG. 1, the outer wall 19 of the cap 16 can have a vertical length such that, when the cap is screwed onto the bottle, the bottom edge of the outer wall 19 is positioned in contact with or adjacent to the juncture of the body 13 and the shoulder 15 of the bottle 12. When the cap 16 is on the bottle 12, the outer wall 19 of the cap can be generally flush with the body 13 of the bottle, creating a smooth, sleek cylindrical overall appearance of the container 10. In some embodiments, the outer wall 19 can be narrower than the body 13 of the bottle 12 and/or the outer wall can terminate at an edge spaced slightly above the shoulder 15, leaving a gap therebetween. In some embodiments, the outer surfaces of the upper wall 17 and the outer wall 19 can comprise a metallic surface that can reflect light, contrast with the bottle 12, and generally improve the aesthetic appearance of the container 10. The inner surface of the outer wall 19 can be clear, mirrored, reflective, and/or white colored.

As shown in FIGS. 5-10, the cap 16 can include a hinged spout 20, made of plastic, metal or other suitable material. As shown in FIG. 6A, the spout 20 can comprise two internal passageways, with one being greater in cross-sectional area than the other. The wider passageway can be a fluid passageway 22 and the narrower passageway can be an air passageway 24. In other embodiments, the air passageway can be larger than or equal in size with the liquid passageway. In some embodiments, the air passageway 24 can include a small blow hole (not shown) located through the spout 20 along the length of the stem. In some embodiments, the fluid passageway 22 can have rounded internal edges that can reduce flow disruption and/or drag on the liquid and can result in a smoother pour.

Figure 6A:
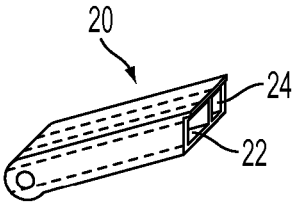
FIG. 6A is a perspective view of an exemplary spout.
Figure 6B:
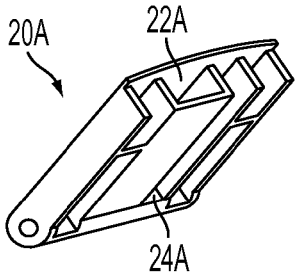
FIG. 6B is a perspective view of another exemplary spout.
Figure 7:
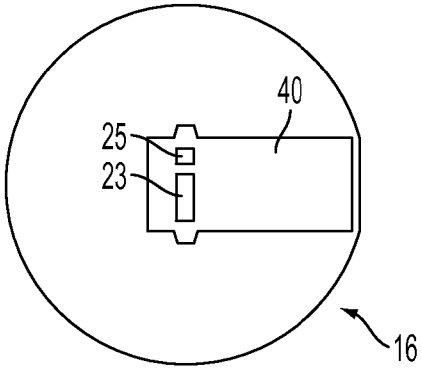
FIG. 7 is a top view of an exemplary cap.

An alternative spout embodiment 20A is shown in FIG. 6B. The spout 20A can comprise a fluid passageway 22A, similar to the spout 20, and an open channel leading to shorter air passageway, or opening, 24A, in place of the air passageway 24 of the spout 20. The air passageway 24A can allow air to enter at a location space apart from the outlet of the fluid passageway 22A, which can reduce the risk of the liquid getting into the air passageway 24A and clogging it. In addition, the spout 20A can have a greater width and comprise additional reinforcing elements on either side of the passageways 22A, 24A to make the spout 20A stronger. Either of the spouts 20 and 20A can be used in any of the embodiments disclosed herein. Embodiments of the cap 16 configured to be used with the wider spout 20A can have an equivalently wider recessed portion 40 (see FIG. 7).

Figure 10:
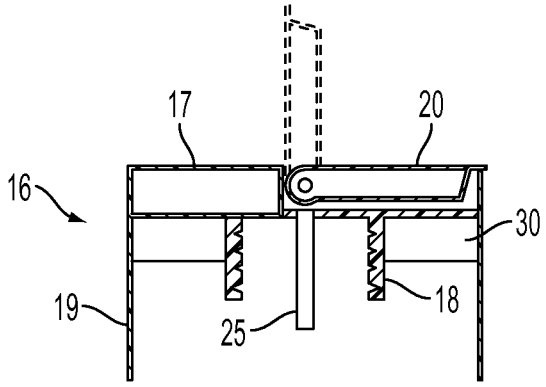
FIG. 10 is a cross-sectional side view of the cap, spout and light ring of FIG. 9 assembled together.
Figure 12:
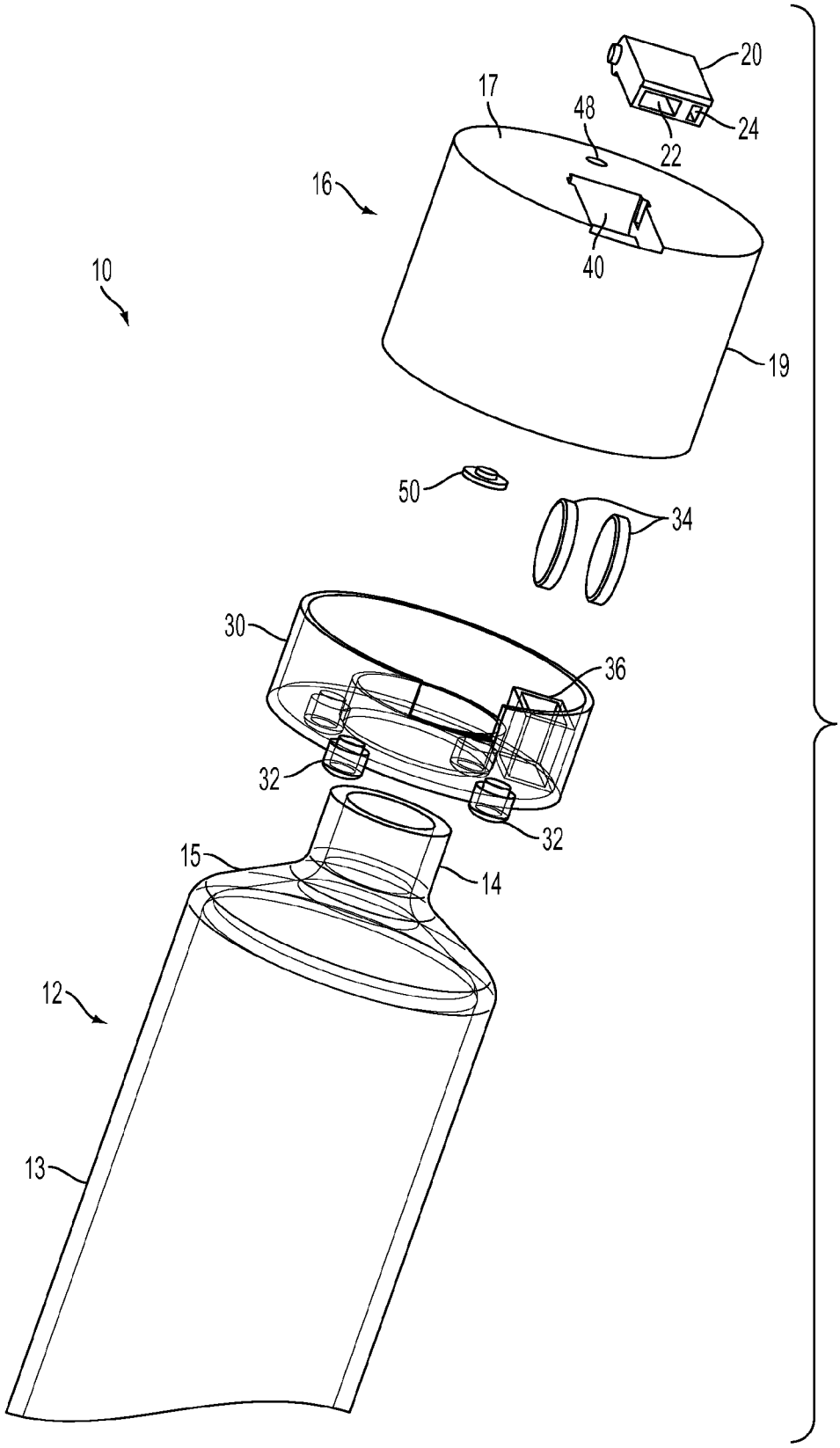
FIG. 12 is an exploded isometric view of the container of FIG. 1.
Figure 13:
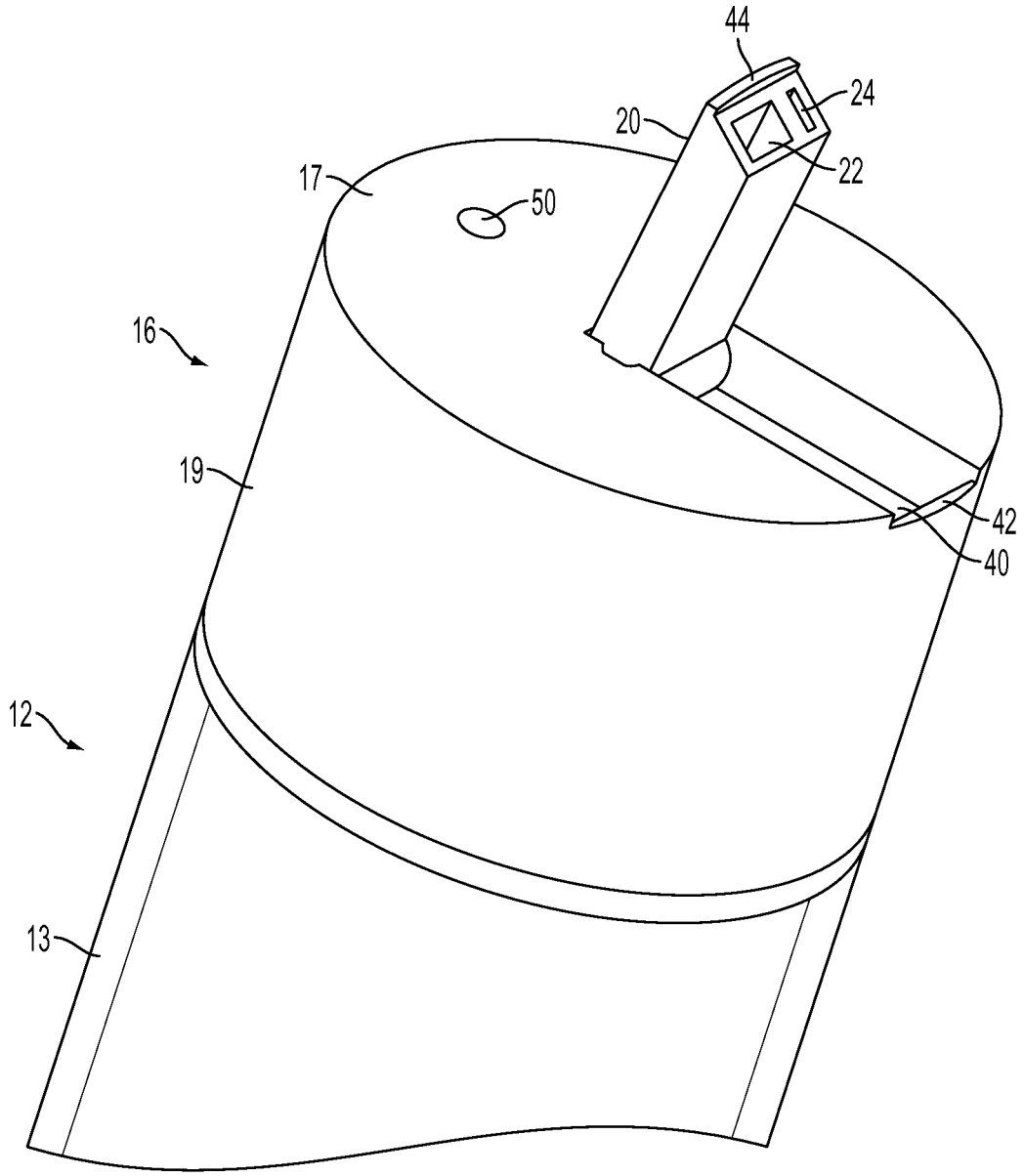
FIG. 13 is an isometric view of the cap and spout of the container of FIG. 1.
Figure 15A:
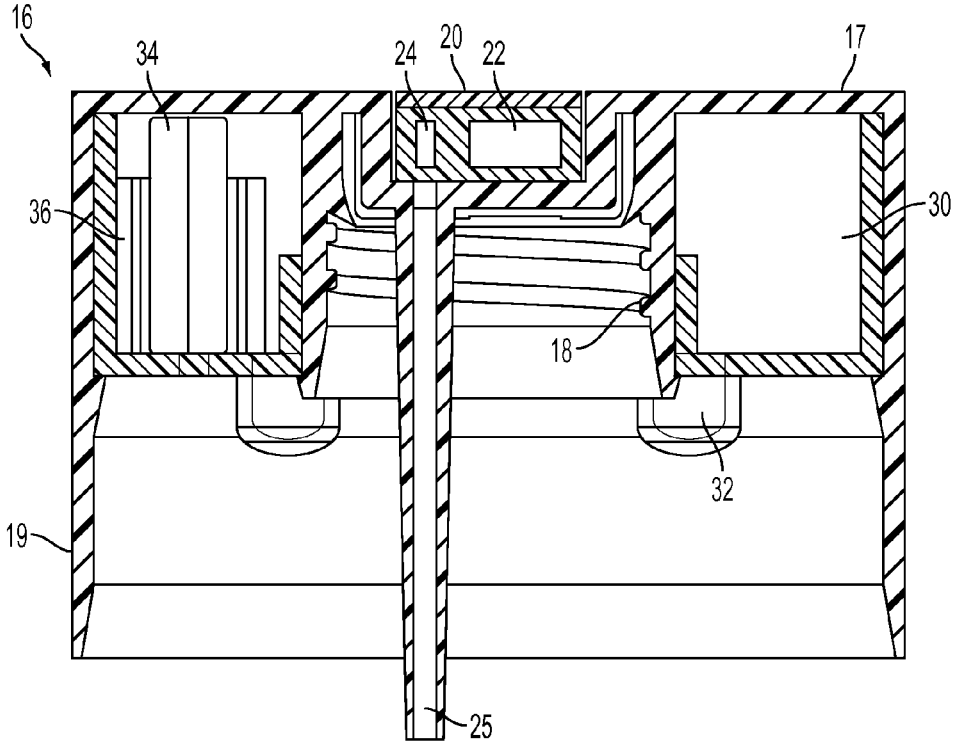
FIG. 15A is a cross-sectional side view of the cap and spout of FIG. 1, with the light ring of FIG. 11A.

As shown in FIGS. 10 and 13, one end of the spout 20 can be pivotally coupled, or hinged, to the a central portion of upper wall 17 of the cap 16 while the opposite end of the spout can be free to pivot between a horizontal closed position (such as is shown in FIG. 1) and a vertical or inclined open position (such as is shown in FIG. 13). The internal passageways 22 and 24 can extend longitudinally through the spout 20 and be open at both opposite ends, as shown in FIGS. 12, 13 and 15. When the spout 20 is in the closed position, the passageways 22 and 24 can be blocked off, making an air-tight seal to protect the contents of the bottle.

The upper wall 17 of the cap 16 can comprise a pair of apertures 23, 25 (see FIGS. 7 and 14) that correspond in cross-sectional size and location to the passageways 22, 24 in the spout 20. With the spout 20 in the open position, as shown in FIG. 13, the passageways 22, 24 of the spout 20 can align with the apertures 23, 25 of the cap 16 to allow fluid flow therethrough. The liquid aperture 23 can be a simple opening in the upper wall 17 of the cap 16. The air aperture 25, however, can comprise an elongated, generally vertical tubular structure extending downwardly from the upper wall 17, as shown in FIGS. 8, 10, 14 and 15. This structure 25 can extend into the bottle 12 through the neck 14 and provide a vent for air to enter the bottle without passing through the liquid passageway 22 and reduce pressure drops within the bottle during pouring.

A gasket (not shown) can be positioned between the passageways 22, 24 of the spout 20 and the apertures 23, 25 of the cap. Such a gasket can help seal of the apertures 23, 25 when the spout 20 is in the closed position, and can help prevent liquid from leaking out between the cap and the spout.

With the spout in this open position, when the container 10 is tilted, liquid can pass out of the bottle through the liquid aperture 23 and liquid passageway 22 while air can flow into the bottle through the air passageway 24 and air aperture 25. This dual passageway system allows for pressure equalization within the bottle during pouring, without the need for a separate air-inlet opening elsewhere in the cap or bottle. This pressure equalization can allow for smoother and/or faster pouring without air bubbles passing upstream through the outflowing liquid and its passageway 22. Air instead enters through the air passageway 24 and air aperture 25, such that air bubbles are formed at the end of the aperture 25. The rectangular or square shape of the air passageways 24 and air aperture 25 can aid in the creation of air bubbles, increasing their aesthetic effect.

In the closed position, as shown in FIG. 1, the passageways 22, 24 can rotate such that they are not aligned with the apertures 23, 25. In this position, the apertures 23, 25 can be blocked by a solid surface of the spout 20 such that fluid cannot flow into or out of the bottle 12. The upper wall 17 of the cap 16 can comprise a recessed portion 40 (see FIG. 13) shaped and sized to receive the spout 20 when the spout is folded down in the closed position such that the upper surface of the spout forms a generally flush, flat surface with the remainder of the upper surface of the cap (see FIGS. 1 and 15). In some of these embodiments, this recessed portion 40 of the cap 16 comprises a front lip 42 (see FIG. 13) that blocks the outer openings of the passageways 22, 24. This front lip 42 can prevent contamination of the passageways 22, 24 when the container is in the closed position, such as when on display. This feature can prevent flies, micro-organisms, or other foreign materials from entering the spout 20. In addition, in some embodiments, the spout 20 can comprise a front flange 44 (see FIG. 13) that overhangs the front lip 42 to further protect the passageways 22, 24 and also facilitate opening the spout. In some embodiments, the front lip 42 can comprise a concave recessed portion to provide a place for a user's finger to grip under the front flange 44 of the spout 20 in order to open the spout. In some embodiments, a gasket (not shown) can positioned within the recessed portion 40 to help seal off the ends of the passageways 22, 24 when the spout is in the closed position.

In some embodiments, the container 10 can further comprise a sealing member, or peel tab, (not shown) that completely covers the spout 20 in an air-tight manner, such as with an adhesive, and that can be removed prior to opening the spout. Such a sealing member can indicate that a cap is new and has not yet been used.

The spout 20 can also be pivoted to other pivotal positions, such as intermediate the open and closed positions, where the apertures 23, 25 are partially blocked and partially fluidly coupled with the passageways 22, 24. Such an intermediate position can be used, for example, to create a reduced fluid outflow rate.

When in the fully open position, the configuration of the apertures 23, 25 and passageways 22, 24 can create a desired constant fluid flow rate out of the container 10. In one embodiment, for example, the constant fluid flow rate can be equal to a flow rate of a conventional bottle pourer, such as 1 ounce per four seconds for example. The flow rate can be increased or decreased by adjusting the cross-section area of various portions of the apertures 23, 25 and/or the passageways 22, 24.

As shown in FIG. 12, the cap 16 can further comprise an aperture 48 in the upper wall 17 spaced from the recessed portion 40. A control switch 50, such as a manual button-type switch, can be positioned in the aperture 48 such that an upper portion of the switch forms a water-tight seal against the perimeter of the aperture. The switch 50 can comprise an electrical component covered by a sealing material, such as rubber. The switch 50 can be electrically coupled to a lighting system, as described below.

Figure 8:
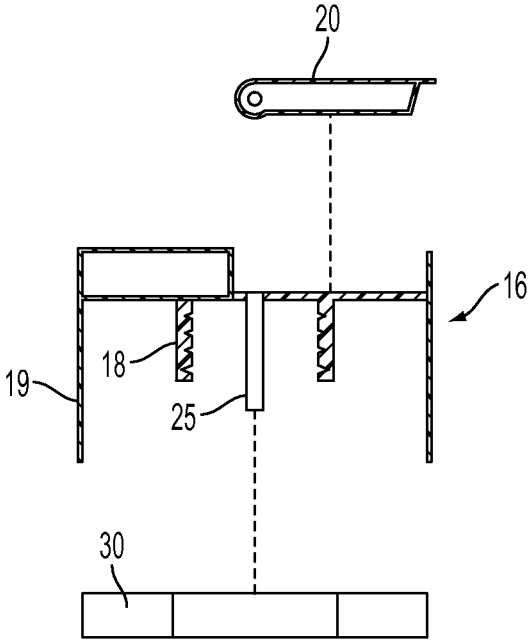
FIG. 8 is an exploded cross-sectional side view of the cap of FIG. 7 with the spout of FIG. 6A and an exemplary light ring.
Figure 9:
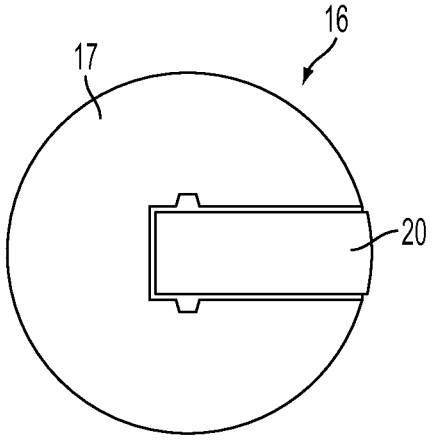
FIG. 9 is a top view of the cap of FIG. 7 with the spout of FIG. 6A pivotally coupled to the cap.

The inner wall 18 and outer wall 19 of the cap 16 can form an annular recess beneath the upper wall 17, as shown in FIGS. 8 and 14. A correspondingly sized annular light ring 30 can be positioned within the annular recess, as shown in FIGS. 10 and 14. The light ring can have a thickness, or depth slightly less than the height of the inner wall 18. The light ring 30 can be held in place within the cap 16 by any conventional means, such as a friction fit, mechanical locking means, adhesives, and the like. A lower surface of the light ring 30 can comprise an aperture through which air or other fluids can be injected to increase the pressure between the light ring 30 and the cap 16 and force the assembly apart (see FIG. 14).

Figure 11A:
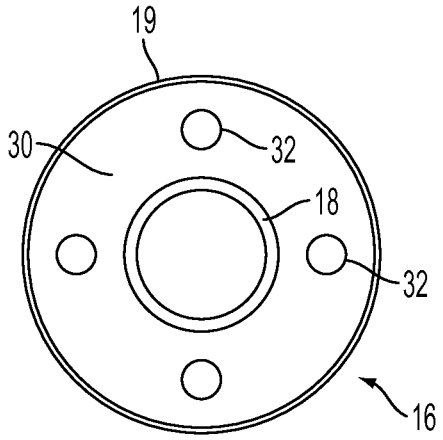
FIG. 11A is a bottom view of a cap with one embodiment of the light ring.
Figure 11B:
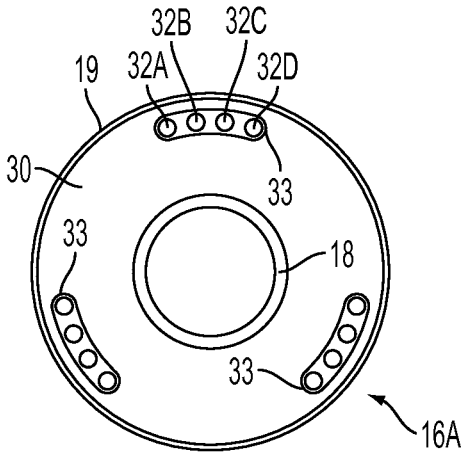
FIG. 11B is a bottom view of a cap with another embodiment of the light ring.
Figure 14A:
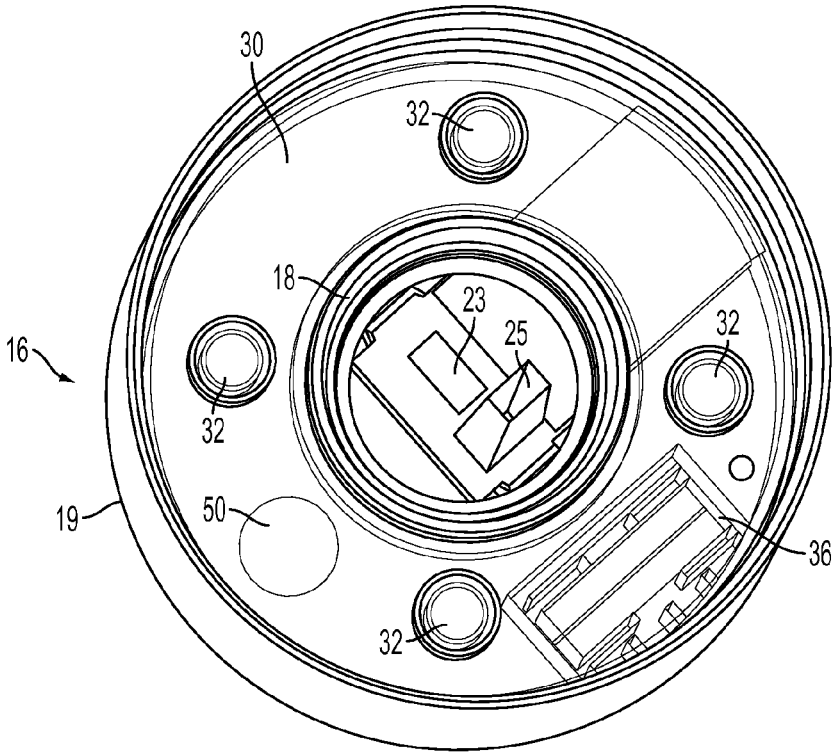
FIG. 14A is an isometric view of the bottom of the cap of FIG. 1, with the light ring of FIG. 11A.
Figure 14B:
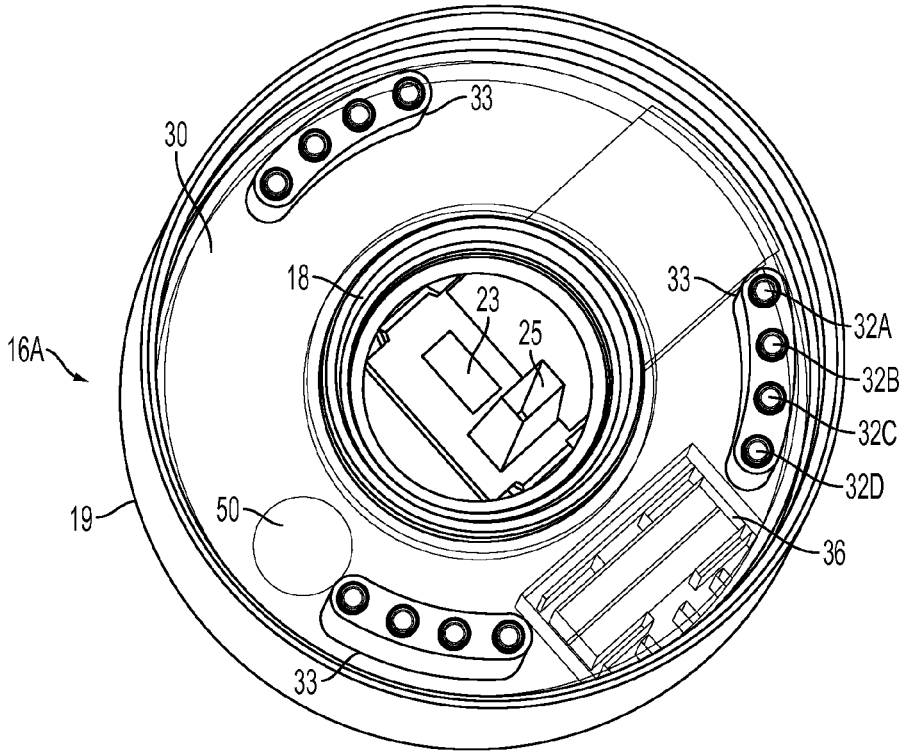
FIG. 14B is an isometric view of the bottom of the cap of FIG. 1, with the light ring of FIG. 11B.
Figure 15B:
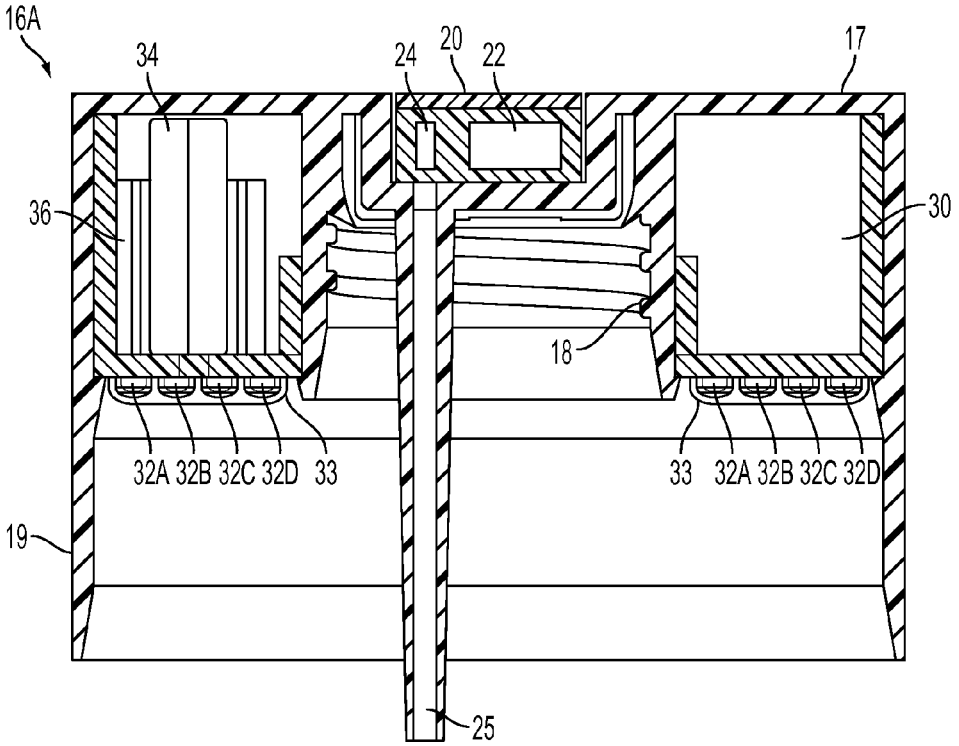
FIG. 15B is a cross-sectional side view of the cap and spout of FIG. 1, with the light ring of FIG. 11B.

As shown in FIGS. 11, 14 and 15, the light ring 30 can include a lighting system having one or more light sources, or lights, 32, such as comprising LEDs, that emit light generally downwardly from the light ring toward the shoulder 15 of the bottle 12. The light sources 32 can be arranged in any pattern, such as spaced apart in regular intervals around the light ring 30 and/or evenly spaced between the inner wall 18 and outer wall 19 of the cap 16, as shown in FIG. 11A. In some embodiments, the light sources 32 can be positioned closer to the outer wall 19 of the light ring 30 and farther from the inner wall 18, as shown in FIGS. 11B. In some embodiments, four light sources 32 can arranged in equally spaced intervals around the light ring 30, as shown in FIGS. 11A and 14A. In other embodiments, plural light source groups 33, such as three groups, can be arranged in equally spaced intervals around the light ring 30, as shown in FIGS. 11B and 14B. In such embodiments, each of the light source groups 33 can comprise more than one light source, such as a group of four light sources 32A, 32B, 32C, 32D, as shown in FIGS. 11B, 14B and 15B. Each of the groups 33 can comprise one light source 32A, one light source 32B, one light source 32C, and one light source 32D, for example. The light ring 30 can also comprise a compartment 36 for holding one or more batteries 34 (see FIGS. 12, 14 and 15) that supply power to the light sources 32.

Light emitted from the light sources 32 can illuminate the bottle 12 in a variety of manners. The light sources 32 can be controlled with a pre-programmed control circuit electrically coupled to the batteries 34, the light sources 32, the control switch 50 and optionally one or more sensors positioned on and/or in the container 10. The control switch 50 can be a button that can be depressed and released to change the setting of the lighting system. In some embodiments, the lighting system can include a sound sensor and can be sound activated. In some embodiments the lighting system can be touch activated, such that a finger touch on the cap activates the lighting system. In some embodiments, the lighting system can be motion activated, such that moving the bottle and/or cap activates the lighting system. In some embodiments, activating the control switch 50 once can turn the lighting system on and activating the switch again can turn the lighting system off.

In some embodiments, the lighting system can have a plurality of settings such that pressing the button repeatedly can cycle the lighting system through the plurality of settings and eventually turn the lighting system off. In each of the settings, the control circuit can cause the light sources 32 to remain constantly on, can cause the light sources 32 to alternate between on and off, such as in a regular or random flashing pattern, a strobe pattern, or a sequenced pattern, and/or can fade the intensity of the light between off and fully on. In addition, in some embodiments, different lights sources 32 can emit different colors of light and/or can flash in different patterns. For example, in embodiments having plural groups 33 each having four light sources 32A, 32B, 32C, 32D, as shown in FIGS. 14B and 15B, the light sources 32A can emit a first color, the light sources 32B can emit a second color, the light sources 32C can emit a third color, and the light sources 32D can emit a fourth color. In some embodiments, a single light source 32 can emit more than one color, such as in an alternating pattern. The light sources 32 can be configured to emit any one or more colors of light, such as red, white, green, blue, etc.

In one example, pressing the button 50 once can turn all the lights 32 on to a first color, pressing the button a second time can turn one or more of the lights to a second color, pressing the button a third time can cause one or more of the lights to flash on and off, pressing the button a fourth time can cause one or more of the lights flash between different colors, pressing the button a fifth time can cause all of the lights to strobe the same color, and so forth. Any number and combination of different lighting settings and/or different light colors can be included.

In another example related to the embodiment of FIGS. 14B and 15B, pressing the button 50 once can turn on all the lights 32A (one light in each of the groups 33) which emit a first color. Pressing the button 50 a second time can turn off the lights 32A and turn on all of the lights 32B, which emit a second color. Pressing the button 50 a third time can turn off the lights 32B and turn on all of the lights 32C, which emit a third color. Pressing the button 50 a fourth time can turn off the lights 32C and turn on all of the lights 32D, which emit a fourth color.

Additional settings related to the embodiment of FIGS. 14B and 15B can be included. In one setting, all of the lights 32A strobe on and off (such as a white color) while the other lights remain off. In another setting, two or more of the lights 32 in each group 33 are on while the other light(s) remain off. For example, only the lights 32B and 32D can be on and can emit red light and blue light, respectively, to create purple/violet colored light. In another setting, the two or more of the four lights 32A-32D can cycle being on one at a time such that the emitted light periodically changes color.

In a particular example related to the embodiment of FIGS. 14B and 15B, pressing the button 50 repeatedly cycles through seven settings, or functions. In the "off" function, all lights are off. In the "flight" function, all of the lights 32A strobe between on and off, and emit white light. The flight function can be used during transportation and delivery of the container 10 to a table/customer. The flight function can also be used to replace dangerous pyrotechnics. In the "landing" function, all lights 32A remain on and emit white light. The landing function can be used when the bottle arrives at a table. In the "red" function, all the lights 32A are off and all of the lights 32B remain on and emit red light. The red function can indicate that the people at the table where the bottle is located are unavailable and do not wish to be disturbed. In the "green" function, all the lights 32B are off and all of the lights 32C remain on and emit green light. The green function can be used indicate that one or more people at the table where the bottle is located are available and are open to conversation. In the "blue" function, all the lights 32C are off and all of the lights 32D remain on and emit blue light. The blue function can signify that the people at the table are indifferent to being approached by others. In the "cycle" function, the lights can cycle between only the white lights 32A being on, then only the red lights 32B being on, then only the green lights 32C being on, then only the blue lights 32D being on, then repeat. The cycle function can include other settings, such as multiple colors on at the same time, in the repeating pattern. The cycle function can indicate that the people at the table are ready to have a good time. Of course many other settings or functions can be included and any of the settings or functions can indicate a wide variety of meanings depending on the understanding of the users and the observers.

In some embodiments, the lighting system can be sound activated and can be programmed to pulse and/or change colors in response to music. In some embodiments, the motion of tipping the bottle to pour out liquid can activate the lighting system, such as by turning on the light sources 32 when the bottle tilts past a certain angle from vertical.

In some embodiments, different light sources 32 can be configured to emit light in different directions. In some embodiments, using feedback from one or more sensors, the color and/or flashing pattern of a light source 32 can change when the container is tilted, touched, changes temperature, and/or when the volume of liquid in the container drops below a certain level.

In some embodiments, the lighting system can be set to turn the lights 32 off after a period of time, such as after 10 minutes to 30 minutes, after turning the lighting system on. This feature can help save battery life and can cause a customer want to use or consume the liquid in the bottle faster. Additionally, this feature can serve as an indicator of how much time has passed since the system was last manually activated, which can increase the quality and timeliness of service to customers and can serve as a visual monitoring device for management to verify consistent service by employees. For example, as long as the lighting system is on, a manager can know that an employee has been to the customer's table within the last 10 minutes.

This disclosure is intended encompass embodiments having additional practical combinations of herein described and similar lighting effects.

As the light emitted from the light sources 32 reaches the outer surfaces of the bottle 12, at least a portion of the light can reflect off the surface of the bottle and at least a portion of the emitted light can pass into the bottle, such as at the shoulder 15 and/or the side walls, and into the liquid within the bottle. In addition, at least a portion of the emitted light can be captured within the walls of the bottle 12, such as via total internal reflection and/or diffusion of the light within the walls, and cause the bottle to glow and/or be illuminated. In some embodiments, the bottle 12 can be made of partially opaque or frosted glass that reflects some incident light at the surface, captures and diffuses some light within the glass, and transmits some light into the liquid. In some embodiments, the surface of the bottle can comprise a texture that causes a desired level of reflection, diffusion and/or transparency. Reflected and diffused light can illuminate the bottle material and the surface of the bottle and thereby increase the brightness and aesthetic appearance of the bottle. Similarly, light passing into the liquid can cause the liquid to glow and/or be illuminated as the light diffuses within the liquid. When the bottle is tilted and the liquid is being poured out of the bottle, air enters through the passageways 24 and 25 and creates air bubbles in the liquid that float upwardly through the liquid. These air bubbles, along with the upper surface of the liquid, can be illuminated by the light passing through the liquid and can appear lighter in color than the liquid, providing a pleasing aesthetic effect.

These lighting effects can create an aesthetic appearance that is desirable for attracting customers' attention to the bottle, such as in a dark bar or night club. The illumination can also assist a bar tender or server in locating and reading the bottle, as well as determining the fluid level within the bottle. The overall sleek, cylindrical shape of the container 10 can also be aesthetically attractive and distinguish the container 10 from other bottles in a display.

In some embodiments, the bottle 12 can comprise three-dimensional, or non-smooth, surface features, such as contours, textures, and protruding labeling, that can interact with the emitted light to create a further enhanced visual appearance.

The cap 16 can be disposable and/or recyclable. In some embodiments, the entire container 10, including the cap 16, can be disposed of when the bottle 12 is empty, and replaced with a new container. In these embodiments, a bar tender or server can save time compared to a conventional situation where a conventional pour spout is pulled out of the empty bottle, a new bottle is located and the cap is twisted off, and the pour spout is shoved into the new bottle. Instead, with the disclosed container 10, when the bottle 12 is empty, the container 10 can be disposed of and a new container 10 can be opened simply by lifting the spout 20 from the closed position to the open position. This simple process can also provide a fresh, clean pour spout for each new bottle, rather than reusing the same conventional pour spout over and over, which can allow a crusty build-up to accumulate around the spout. In addition, the container 10 can be well suited for home and private use as it includes a built-in pour spout, which is not readily available to many consumers.

In addition, the disposable nature of the container 10 can be well suited for "bottle service" methods. In these methods, a container 10 can be provided to a customer at a table or other location remote from a bar where the consumers of the liquor can break the seal, open the spout and pour their own drinks. When the container 10 is empty, they can simply discard the entire container. Furthermore, the lighting effects can create an attractive, desirable atmosphere for the consumers at their table.

The disclosed cap 16 can also be used as a reusable pour spout in some embodiments. For example, the cap 16 can be designed such that the inner wall 18 is threaded to match a conventional liquor bottle. In these embodiments, the cap 16 can be screwed onto a conventional bottle and used to dispense the liquor from that bottle until empty. Then, the cap 16 can be removed, cleaned or wiped, and placed onto a fresh new bottle to be reused.

Another advantage of the disclosed cap 16 is that the cap can be removed from a bottle without touching the spout 20. The cap 16 can be removed by grasping the outer wall 17 and twisting the cap off the bottle 12. By contrast, conventional pour spouts can have limited surface area to grip, causing the hand to touch the spout.

Figure 16:
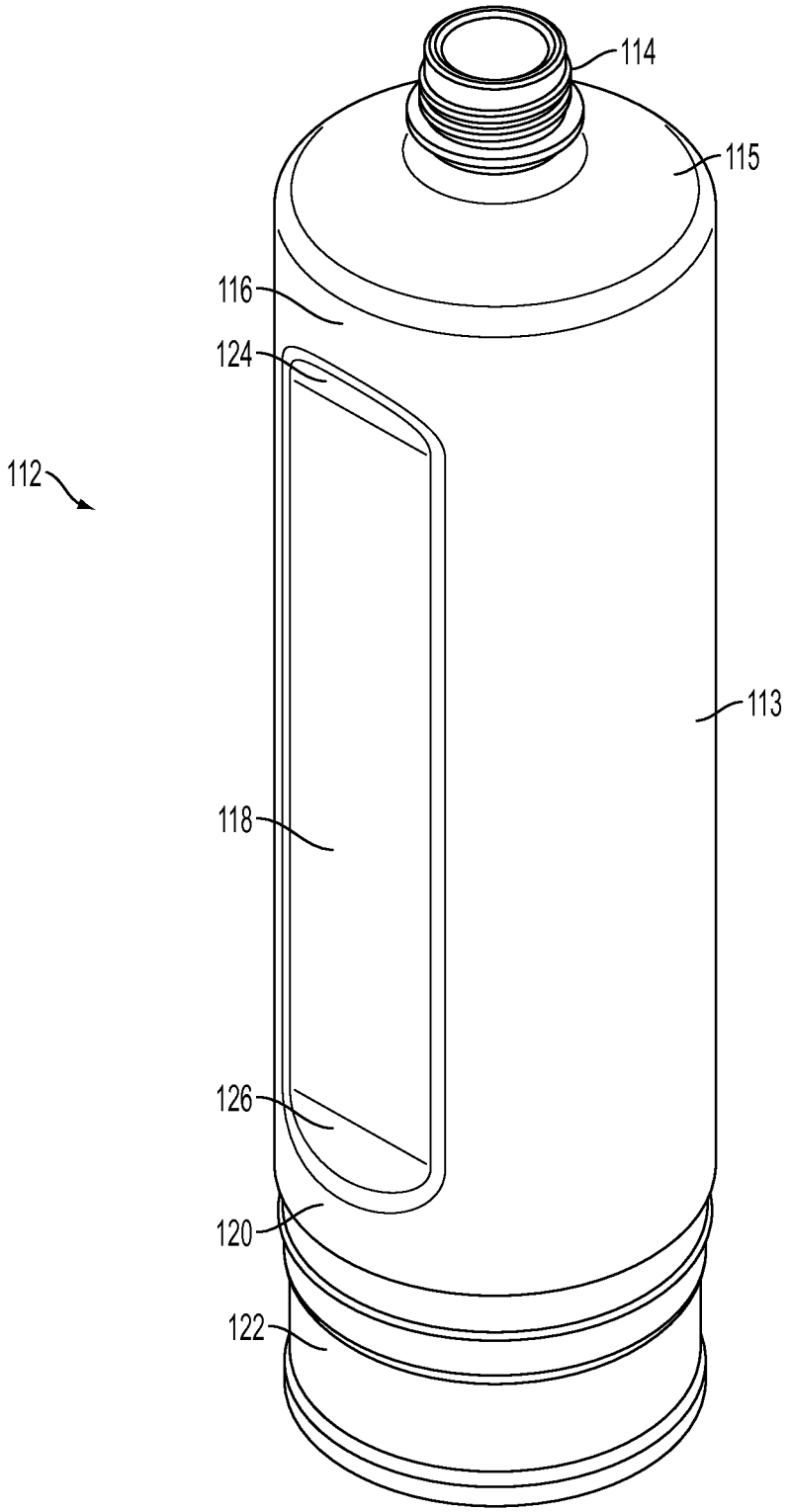
FIG. 16 is a perspective view of another exemplary liquor bottle.
Figure 17:
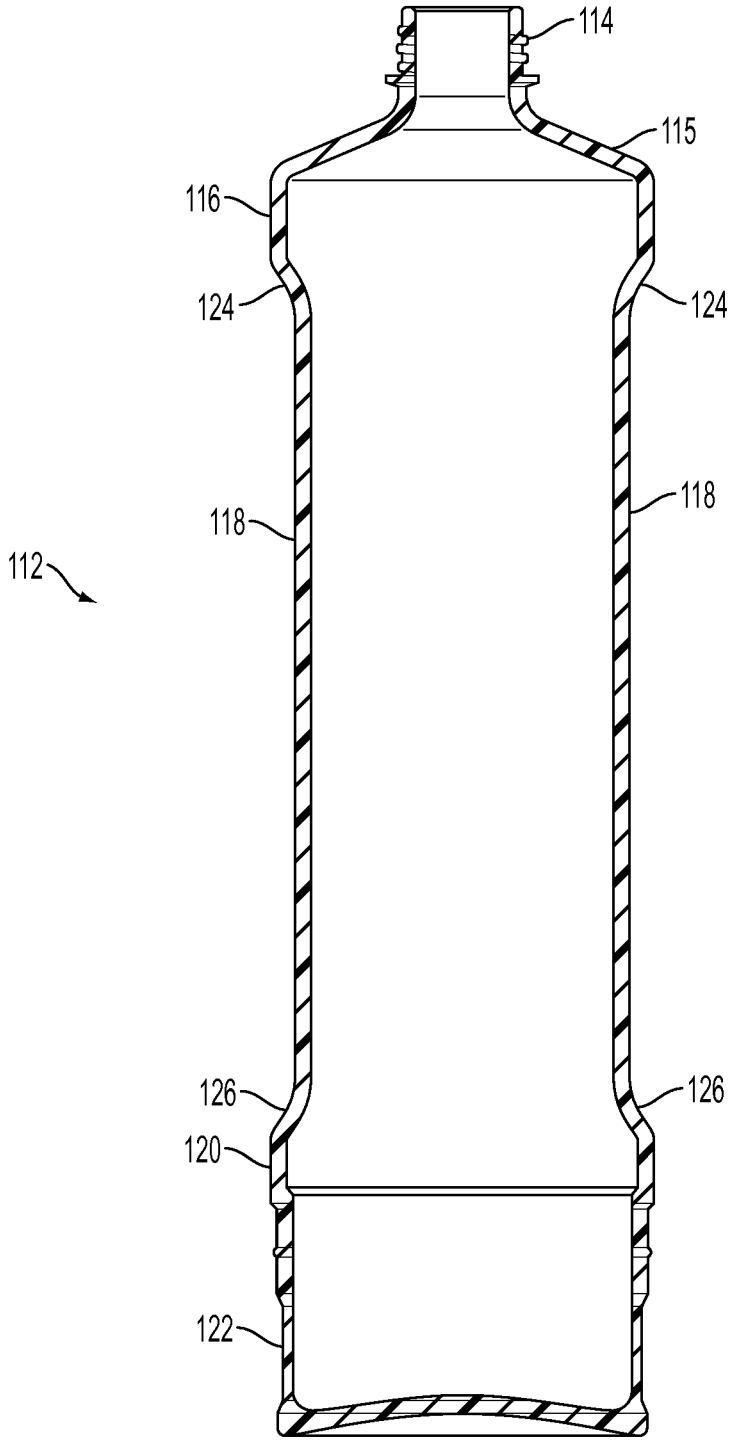
FIG. 17 is a cross-sectional elevation view the liquor bottle of FIG. 16.

The cap 16 can be used with variously shape bottles. FIGS. 16 and 17 show an alternative bottle 112 that can be used with the cap 16. The bottle 112 comprises a generally cylindrical body 113, a tapered shoulder 115, and an externally threaded neck 114 forming an upper opening. The bottle 112 can be comprised of glass, plastic, or other conventional materials. In some embodiments, the bottle 112 is comprised of frosted glass or other semi-transparent material. The bottle 112 can be a one-liter or 750 ml bottle, for example.

The body 113 comprises a cylindrical upper portion 116 adjacent to the shoulder 115, a cylindrical lower portion 120, and a pair of flat regions 118 between the upper and lower portions 116, 120. The flat regions 118 can be on opposite sides of the bottle 112 and can be substantially parallel to one another. The bottle 112 further includes upper tapered regions 124 that transition between the upper ends of the flat regions 118 and the upper portion 116, and lower tapered regions 126 that transition between the lower ends of the flat regions 118 and the lower portion 120. As shown in FIG. 17, the flat regions 118 create a narrowed portion of the body 113 relative to the wider upper portion 116 and the wider lower portion 120. The flat regions 118 can provide a location for attaching a label or other markings. The flat regions 118 can further provide a location for gripping the bottle 112. The tapered regions 124 and 126 can also improve a user's ability to grip the bottle by physically obstructing the bottle from sliding out of the user's hand, such as when the bottle is wet.

The bottle 112 can further comprise a narrowed bottom portion 122 that is configured to receive an end cap (not shown) that covers the bottom portion 122. The end cap can comprise an annular band of opaque polymeric or metallic material, such as having a shiny or reflective surface, and can have about the same diameter as the lower portion 120 of the body. The end cap can further cover at least a portion of the bottom surface of the bottle. In one embodiment, the end cap covers an outer perimeter of the bottom surface of the bottle and defines a circular opening at the center of the bottom of the bottle through which light can pass. The circular opening can have a bright appearance in contrast with the opaque material of the end cap that surrounds the circular opening. In some embodiments, the end cap can be similar is shape and appearance to the outer surfaces of the cap 16, providing a symmetrical appearance to the container.

In view of the many possible embodiments to which the principles of the disclosure may be applied, it should be recognized that the illustrated embodiments are only preferred examples and should not be taken as limiting the scope of the invention. Rather, the scope of the invention is defined by the following claims. We therefore claim as our invention all that comes within the scope of these claims.

We claim:

1. A cap for a liquor bottle, the cap comprising:

an upper wall;

an outer annular wall extending downwardly from an outer periphery of the upper wall;

an internally threaded inner annular wall extending downwardly from the upper wall and configured to be threaded onto an externally threaded neck of a liquor bottle to secure the cap to the liquor bottle;

an annular light ring positioned between the outer wall and the inner wall, the light ring comprising light sources configured to emit light downwardly from the light ring toward an external surface of an annular shoulder of the liquor bottle such that a portion of the light passes through the shoulder of the liquor bottle;

wherein the outer wall has an outer diameter that is about equal to an outer diameter of the shoulder of the liquor bottle and a lower edge of the outer wall is configured to be adjacent to an outer periphery of the shoulder when the cap is secured to the liquor bottle.

2. The cap of claim 1, wherein the light ring comprises an inner annular surface abutting the inner wall and an outer annular surface abutting the outer wall, such that the light ring fits snuggly between the inner wall and the outer wall.

3. The cap of claim 1, wherein the light ring is configured to be positioned around the threaded neck of the liquor bottle when the cap is secured to the liquor bottle.

4. The cap of claim 1, wherein the light ring further comprises a manual switch in electrical communication with the light sources and configured to cause the light sources to emit light in at least three different manners in response to actuation of the switch.

5. The cap of claim 4, wherein the switch protrudes through the upper wall.

6. The cap of claim 1, wherein the light sources are positioned closer to the outer wall than to the inner wall.

7. The cap of claim 1, wherein the light ring comprises plural light source groups spaced apart evenly around the light ring, each light source group comprises plural light sources, and each light source of a light source group is configured to emit a different color of light.

8. The cap of claim 1, wherein the outer wall comprises a reflective inner surface.

9. The cap of claim 1, wherein the light ring comprises plural light sources each configured to emit a different color of light.

10. The cap of claim 9, wherein the light sources include a first light source configured to emit green light and a second light source configured to emit red light, whereby a user can selectively activate one or both of the first and second light sources such that the illuminated cap and any bottle attached thereto are observable by people in the vicinity.

11. The cap of claim 9, wherein the light sources include a third light source configured to emit white light, whereby the user can selectively activate one or more of the first, second and third light sources to create an illuminated cap.

12. A cap for a liquor bottle, the cap comprising:

an upper wall;

an outer annular wall extending downwardly from an outer periphery of the upper wall;

an internally threaded inner annular wall extending downwardly from the upper wall and configured to be threaded onto an externally threaded neck of a liquor bottle to secure the cap to the liquor bottle;

an annular light ring positioned between the outer wall and the inner wall, the light ring comprising light sources configured to emit light downwardly from the light ring toward an external surface of an annular shoulder of the liquor bottle such that a portion of the light passes through the shoulder of the liquor bottle;

a first opening in the upper wall configured to allow fluid to flow from an opening in the threaded neck of the liquor bottle through the upper wall;

a second opening in the upper wall configured to allow air to flow through the upper wall into the liquor bottle; and a spout pivotally coupled to the upper wall and comprising a first passageway and a second passageway, wherein the spout is configured to pivot between an open position wherein the first and second passageways are in liquid communication with the first and second openings, respectively, and a closed position wherein the first and second openings are blocked by the spout.

13. The cap of claim 12, wherein the first and second passageways are parallel and extend longitudinally through the spout between a pivoted end of the spout and a free end of the spout.

14. The cap of claim 12, further comprising an elongated tubular structure defining the second opening and extending downwardly from the upper wall within the inner wall and configured to extend into the liquor bottle when the cap is secured to the liquor bottle.

15. The cap of claim 12, wherein the first opening has a greater cross-sectional area than the second opening.

16. The cap of claim 12, wherein an upper surface of the spout is flush with the upper wall when the spout is in the closed position.

17. The cap of claim 12, wherein the first and second passageways have rectangular cross-sections perpendicular to their longitudinal lengths, the cross-sections of the first and second passageways having substantially equal heights, the cross-section of the first passageway having a greater width than the cross-section of the second passageway.

18. The cap of claim 12, further comprising an elongated tubular structure defining the second opening and extending downwardly from the upper wall within the inner wall and configured to extend into the liquor bottle when the cap is secured to the liquor bottle.

19. The cap of claim 18, wherein the elongated tubular structure has a rectangular horizontal cross-section and defines a rectangular, vertical internal passageway.

20. A cap for a liquor bottle, the cap comprising:

a circular upper wall having a flat upper surface;

a cylindrical outer wall extending downwardly from an outer periphery of the upper wall;

an internally threaded annular inner wall extending downwardly from the upper wall within the outer wall and configured to be threaded onto an externally threaded neck of a liquor bottle to secure the cap to the liquor bottle;

a first opening in the upper wall within the inner wall configured to allow fluid to flow from an upper opening of the liquor bottle through the upper wall when the cap is secured to the liquor bottle;

a second opening in the upper wall within the inner wall configured to allow air to flow through the upper wall into the liquor bottle when the cap is secured to the liquor bottle;

a spout pivotally coupled to the upper wall and comprising a first passageway and a second passageway, wherein the spout is configured to pivot between an open position wherein the first and second passageways are in liquid communication with the first and second openings, respectively, and a closed position wherein the first and second openings are blocked by the spout and an upper surface of the spout is generally flush with the upper wall;

an annular light ring positioned between the outer wall and the inner wall below the upper wall and configured to be positioned around the threaded neck of the liquor bottle when the cap is secured to the liquor bottle, the light ring comprising light sources configured to emit light downwardly from the light ring toward an annular shoulder of the liquor bottle such that a portion of the emitted light passes through the shoulder of the liquor bottle and illuminates the bottle and its contents;

wherein the light sources are configured to emit light in at least three different manners in response to manual actuation of a switch.

* * * * *